US005131817A

United States Patent [19]

Pastore, Jr.

[11] Patent Number: 5,131,817

[45] Date of Patent: Jul. 21, 1992

[54] TWO-STAGE PUMPING SYSTEM

[75] Inventor: Michael J. Pastore, Jr., Palm Harbor, Fla.

[73] Assignee: The Nash Engineering Company, Norwalk, Conn.

[21] Appl. No.: 497,326

[22] Filed: Mar. 22, 1990

[51] Int. Cl.[5] ..... F04C 19/00

[52] U.S. Cl. ..... 417/69; 417/205; 417/243; 418/1; 418/97

[58] Field of Search ..... 417/68, 69, 62, 205, 417/243; 418/1, 9, 97, 99, 100

[56] References Cited

U.S. PATENT DOCUMENTS

| | | | |
|---|---|---|---|
| 117,626 | 8/1871 | Haskins . | |
| 1,097,783 | 5/1914 | Wolf | 418/1 |
| 1,155,335 | 10/1915 | Bricknell et al. . | |
| 1,340,165 | 5/1920 | Grace . | |
| 1,491,993 | 4/1924 | McCuen | 418/97 |
| 2,404,660 | 7/1946 | Rouleau | 230/208 |
| 2,971,691 | 2/1961 | Lorenz | 230/45 |
| 3,105,630 | 10/1963 | Lowler et al. | 230/31 |
| 3,109,297 | 11/1963 | Rinehart | 62/197 |
| 3,231,179 | 1/1966 | Jaquith | 418/99 |
| 3,289,591 | 12/1966 | Eriksson | 418/99 |
| 3,307,777 | 3/1967 | Schibbye | 230/143 |
| 3,430,848 | 4/1969 | Turner et al. | 418/99 |
| 3,575,539 | 4/1971 | Hanick | 418/99 |
| 3,642,384 | 2/1972 | Huse | 417/205 |
| 3,910,731 | 10/1975 | Persson et al. | 418/9 |
| 3,922,110 | 11/1975 | Huse | 417/2 |
| 3,956,072 | 5/1976 | Huse | 202/177 |
| 4,123,203 | 10/1978 | Kathmann et al. | 417/252 |
| 4,452,575 | 6/1984 | Schibbye et al. | 418/1 |
| 4,789,314 | 12/1988 | Higuchi et al. | 418/9 |
| 4,812,110 | 3/1989 | Kubo | 418/1 |

FOREIGN PATENT DOCUMENTS

| | | | |
|---|---|---|---|
| 1428248 | 2/1969 | Fed. Rep. of Germany . | |
| 1129872 | 1/1957 | France . | |
| 58-183888 | 10/1983 | Japan . | |
| 810166 | 3/1959 | United Kingdom | 417/69 |

*Primary Examiner*—Richard A. Bertsch
*Assistant Examiner*—Michael I. Kocharov
*Attorney, Agent, or Firm*—Robert R. Jackson

[57] ABSTRACT

In a gas pumping system including a first stage rotary lobe pump for pumping gas to a second stage liquid ring pump, cooling liquid is injected into the compression zone of the rotary lobe pump so that the liquid mixes intimately with the gas being compressed in that zone and reduces the temperature rise of the gas in that zone in order to reduce heat transfer from that gas to the lobes of the rotary lobe pump.

24 Claims, 2 Drawing Sheets

TWO-STAGE PUMPING SYSTEM

BACKGROUND OF THE INVENTION

This invention relates to gas or vapor pumping systems, and more particularly to hybrid gas or vapor pumping systems including a rotary lobe or Roots pump as a first stage and a liquid ring pump as a second stage. The invention is especially of interest in connection with pumping systems for providing reduced pressure or "vacuum". For convenience herein, gases and vapors are referred to generically as gas.

Two-stage gas pumping systems having a Roots pump as a first stage and a liquid ring pump as a second stage are known as shown, for example, by Huse U.S. Pat. Nos. 3,642,384, 3,922,110, and 3,956,072. In such systems, the pressure differentials at which the rotary lobe pump can operate are primarily limited by the temperature differential across the pump. The components of a rotary lobe pump operate with close clearances, and the thermal expansion of these components must be controlled. At high vacuum this thermodynamic consideration becomes more acute because the less dense gas being pumped has less ability to transfer heat from the pump components.

Various techniques are known for limiting temperature rise through a rotary lobe pump. One of these techniques is the injection of a cooling liquid (e.g., water) into the inlet of the pump (see, for example, Huse U.S. Pat. Nos. 3,642,384 and 3,922,110). Although sometimes useful, this method can adversely affect available rotary lobe pump capacity due to the introduction of additional vapor load. Also, at higher vacuum levels, the vapor pressure of the injection liquid may become critical and therefore a limiting factor. For example, water generally cannot be used as the injection liquid when the inlet pressure drops below 20 mm HgA. In addition, the amount of liquid that can be injected is limited, and when water is used, there is the potential for plating of minerals on the lobes as the water passes through the rotary lobe pump.

Another known technique for limiting the temperature rise across a rotary lobe pump is so-called bypass cooling. In this technique a small amount of gas from the rotary lobe pump discharge is cooled and then reintroduced into the compression chamber of the pump. The principal disadvantage of this approach is the need for and additional expense of the gas cooler. The amount of cooling which can be provided in this way is also limited.

Still another known technique for limiting temperature rise across a rotary lobe pump is jacketed cooling, e.g., with cooling liquid or gas jackets surrounding the pumping chamber of the pump (see, for example, Higuchi et al. U.S. Pat. No. 4,789,314). This avoids the possible problems associated with cooling liquid injection. However, the ability of a cooling jacket to keep the lobes themselves cool is limited. Also, the addition of jackets can significantly increase the cost of the rotary lobe pump.

In view of the foregoing, it is an object of this invention to improve and simplify two-stage gas pumping systems having a rotary lobe pump as a first stage and a liquid ring pump as a second stage.

It is a more particular object of this invention to provide improved and simplified cooling for the rotary lobe pump which is the first stage in a gas pumping system having a liquid ring pump as the second stage.

SUMMARY OF THE INVENTION

These and other objects of the invention are accomplished in accordance with the principles of the invention by providing a two-stage gas pumping system in which cooling liquid (e.g., water) is sprayed into the discharge of the first stage rotary lobe pump so that the liquid mixes intimately with the gas in the compression zone or internal compression chamber of the pump. This prevents or at least substantially reduces heating of the gas being compressed, and thereby similarly prevents or substantially reduces heating of the lobes of the pump by reducing heat transfer from the gas to the pump lobes. For example, the foregoing intimate mixing of the cooling liquid and the gas being compressed may be promoted or ensured by having the cooling liquid which is sprayed into the rotary lobe pump discharge at least partly impinge on the lobes of the pump. After thus cooling the first stage pump, the cooling liquid (and/or any cooling liquid vapor) is conveyed with the gas being pumped to the second stage liquid ring pump. Preferably (although not necessarily) the cooling liquid is the same as the liquid used as the pumping liquid in the liquid ring pump. This allows the cooling liquid to be withdrawn from the normal pumping liquid make-up stream for the liquid ring pump and to serve as part of that make-up stream when it enters the liquid ring pump after having been used to cool the rotary lobe pump.

Further features of the invention, its nature and various advantages will be more apparent from the accompanying drawings and the following detailed description of the preferred embodiments.

DETAILED DESCRIPTION OF THE PREFERRED EMBODIMENTS

Figure 1:
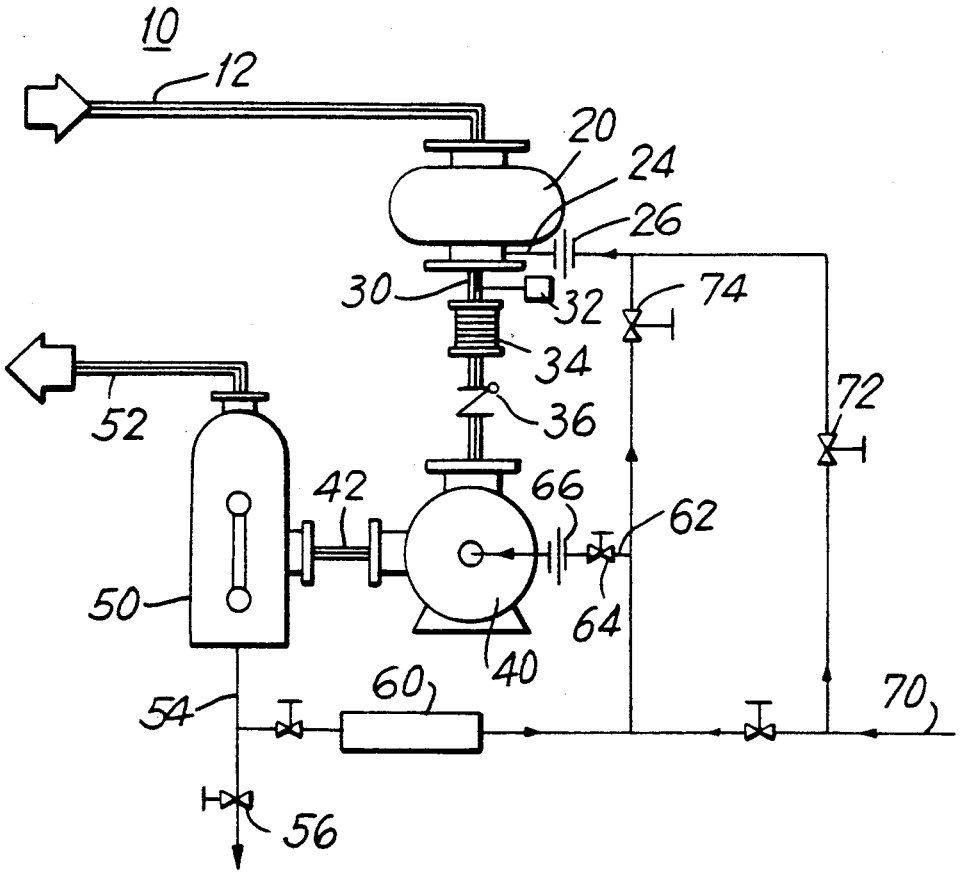
FIG. 1 is a simplified schematic diagram of a pumping system constructed in accordance with the principles of this invention.

An illustrative two-stage gas pumping system 10 constructed in accordance with this invention is shown in FIG. 1. Gas to be pumped enters the system via conduit 12, which conveys the gas to the inlet of rotary lobe pump 20. Pump 20 acts as a first stage or booster for liquid ring pump 40.

Figure 2:
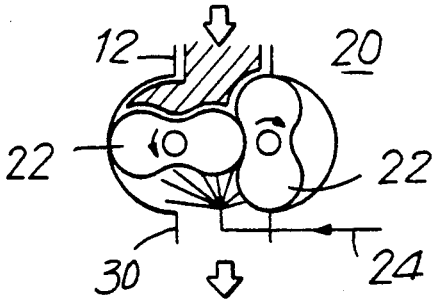
FIG. 2 is a simplified schematic diagram of a rotary lobe pump showing the injection of cooling liquid in accordance with this invention.
Figure 3:
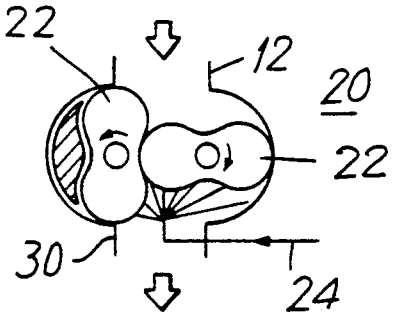
FIG. 3 is similar to FIG. 2 and shows a subsequent stage in the operating cycle of the rotary lobe pump.
Figure 4:
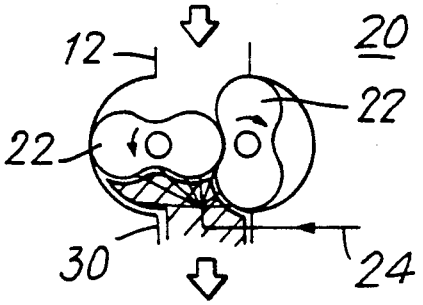
FIG. 4 is again similar to FIGS. 2 and 3 and shows a still later stage in the operating cycle of the rotary lobe pump.

The construction and operation of rotary lobe pump 20 is shown in more detail in FIGS. 2–4. An intake position of lobes 22 is shown in FIG. 2. A dwell position of lobes 22 is shown in FIG. 3. And a compression and exhaust position of lobes 22 is shown in FIG. 4. Note that no compression of the gas occurs until after the dwell position shown in FIG. 3, i.e., until the compression stage illustrated by FIG. 4.

In accordance with this invention and as shown in all of the FIGS., liquid (e.g., water) is sprayed into the discharge of rotary lobe pump 20 from conduit 24 so that this liquid mixes intimately with the gas in the compression zone or internal compression chamber of pump 20. This prevents or at least substantially reduces heating of the gas being compressed. This in turn prevents or substantially reduces heat transfer from the gas being compressed to the lobes 22 of pump 20. Lobes 22 therefore remain relatively cool, thereby greatly improving the performance and extending the operating range of pump 20. If desired to help promote or ensure the above-described intimate mixing of the cooling liquid from conduit 24 and the gas being compressed by pump 20, the cooling liquid spray may be arranged to at least partly traverse the compression zone of pump 20 and impinge on the surfaces of lobes 22 which define that compression zone. This arrangement of the cooling liquid spray is shown in FIGS. 2–4.

Interstage conduit 30 conveys the partially compressed gas and expended cooling liquid from the discharge of first-stage rotary lobe pump 20 to the intake of second-stage liquid ring pump 40. Interstage conduit 30 may include a temperature switch 32 for monitoring the temperature of the gas in conduit 30 and for shutting down booster pump 20 or the entire system if the interstage gas temperature becomes too high (which may indicate that the cooling liquid injection via conduit 24 has failed). Interstage conduit 30 may also include a flexible connection 34 to allow for thermal expansion of the other conduit elements between pumps 20 and 40. A check valve 36 is also preferably included in interstage conduit 30 to prevent liquid from pump 40 from being sucked back into the apparatus upstream of conduit 12 when the system is shut down.

Liquid ring pump 40 further compresses the gas received from interstage conduit 30 and discharges the fully compressed gas to separator 50 via conduit 42. The liquid used as the seal or pumping liquid in liquid ring pump 40 is preferably the same as (or at least compatible with) the liquid injected into the discharge of pump 20 via conduit 24. Accordingly, the cooling liquid injected via conduit 24 mixes with and thereby becomes part of the liquid ring pump pumping liquid when the cooling liquid enters the liquid ring pump.

Separator 50 separates the liquid from the gas discharged by liquid ring pump 40. The gas is discharged from the system via conduit 52. The liquid could be discharged via conduit 54 and valve 56, but instead is preferably recycled by feeding it back to pump 40 and the discharge of pump 20 as will now be described. The loop for thus recycling the liquid from separator 50 preferably includes cooler 60 for cooling the liquid being recycled, e.g., by heat exchange with the atmosphere or a secondary liquid cooling circuit in which the secondary liquid flows countercurrent to the recycled liquid being cooled. A portion of the cooled liquid is then fed back into the liquid ring of pump 40 via conduit 62 (which may include valve 64 and fixed-orifice flow-control device 66). The other cooled liquid in injected into the discharge of pump 20 via conduit 24 as described above. (Conduit 24 may include another fixed-orifice flow-control device 26.) Any liquid losses or withdrawals are made up with fresh liquid from supply conduit 70. Alternatively, if liquid recycling is not used, then the make-up seal liquid for pump 40 and the liquid for injection into the discharge of pump 20 may all be supplied from conduit 70. Or just the liquid for injection into the discharge of pump 20 may be fresh liquid from conduit 70 (supplied via valve 72 with valve 74 shut off). Various other combinations or mixtures of fresh and recirculated liquid may be used as liquid supplies for pumps 20 and 40, and the liquids supplied to the two pumps may be different if desired, as long as they are compatible.

The benefits of this invention are clearly demonstrated by the following comparative examples. The first of the following calculations is for injection of cooling liquid into the intake of the rotary lobe pump (as, for example, in Huse U.S. Pat. No. 3,642,384) rather than into the discharge of that pump as in the present invention. It is assumed that the suction pressure is to be 10.0 Torr (i.e., 10.0 mm Hg absolute (1 atmosphere equals approximately 760 Torr)), that the inlet temperature is 75° F., that the inlet gas is 30 lb/hr air (510 ACFM), that the discharge pressure of the rotary lobe booster pump is 75.0 Torr, that the booster discharge temperature is 952° F. (based on 68% volumetric efficiency ("Ve") and 0.6 temperature rise coefficient ("TRC"), that the injection water temperature is 85° F., and that the maximum desired booster pump discharge temperature is selected to be 250° F. (Note that some of the foregoing values such as Ve and TRC are merely typical and may vary from one booster pump manufacturer to another.) The maximum heatload to cool the gas is $$\begin{aligned} Q &= (M)(Cp)(t_2 - t_1) \\ &= (30\ \text{lb/hr})(.24\ \text{BTU/lb/°F.})(952\text{–}250) \\ &= 5{,}054.4\ \text{BTU/hr} \end{aligned}$$

The amount of water injection required to remove 5,054.4 BTU/hr (using latent heat, h) is $$Q=(5{,}054.4)=(M)(h)$$

Therefore $$M=(5{,}054.4)/(1098)=4.6\ lb/hr=9.2\times10^{-3}GPM$$

where h for water equals 1098 BTU/lb at 85° F. This flow rate is far too low to practically control under process conditions, and any variation in the flow rate and subsequent flash rate may considerably upset the operation of the system.

The solution of the present invention is to inject a relatively large amount of liquid into the discharge of rotary lobe pump 20 and allow the resulting gas/vapor mixture to come to an acceptable equilibrium temperature. The presence of excess "liquid phase" injection water will prevent subcooling and freezing, while the relatively cool equilibrium temperatures minimize vapor loading to liquid ring pump 40. As an example:

Equilibrium temperature: 75.5° F. (this value was derived after several iterations);

Mass, water vapor to saturate at 75.5° F., 75.0 Torr, 30 lb/hr air: 8.0 lb/hr;

Cooling available as a result of flashing water vapor: 8,784 BTU/hr;

Heat load:

A. Gas cooling:

$$Q1=(30)(0.24)(952-75.5)=6{,}311\ BTU/hr$$

B. Liquid cooling (using a more practical, arbitrary rate of 0.5 GPM injection which can be higher as allowed by the ability of the second stage liquid ring pump to accept liquid in its inlet flow):

$Q2=(0.5)(500)(1.0)(85-75.5)=2,375$ BTU/hr

Total = 8,686 BTU/hr

This total approximately equals the available cooling (8,784 BTU/hr). Therefore, using 0.5 GPM injection, the equilibrium temperature would be approximately 75.5° F. Liquid ring pump 40 can now be sized for 30 lb/hr air and 8 lb/hr water vapor at 75.0 Torr and 75.5° F. Water could not have been satisfactorily used for inlet injection (as in the above-mentioned Huse patent) due to its vapor pressure. However, water serves quite well for discharge injection as in the present invention. Without the use of injection liquid, a much larger liquid ring pump 40 would be required (i.e., for 25–30 Torr inlet pressure, given the 85° F. seal water supply temperature).

The foregoing demonstrates that the present invention has a number of important advantages. For example, the invention makes greater compression ratios possible. (Currently, applications are limited by temperature rise.) This in turn reduces the number of booster stages required and/or the size of the required liquid ring pump. The invention is especially useful in systems designed to produce a subatmospheric gas pressure at the rotary lobe pump inlet, and wherein that subatmospheric gas pressure is approximately at or below the vapor pressure of the cooling liquid.

Another advantage of the present invention is that it facilitates simultaneously starting both of pumps 20 and 40 from atmospheric pressure without fear of overheating booster pump 20, even during lengthy evacuation times. The systems of the present invention are exceptional rough vacuum evacuation devices.

Yet another advantage of the invention is that the flow rate of the injection liquid does not have to be carefully controlled because of the unique ability of the liquid ring pump to accept wide variations in the liquid flow rate to its inlet with no adverse effect on its capacity or reliability.

Still another advantage of the present invention is that the use of a liquid ring backing pump 40 eliminates the need for intercoolers or interstage separation devices. The injection liquid can serve as a portion of the liquid ring pump seal liquid.

Yet another advantage of the invention is that the use of injection liquid prevents booster pump 20 overheating during upset or reduced flow conditions where the staging ratio may be extended beyond design.

It will be understood that the foregoing is merely illustrative of the principles of this invention and that various modifications can be made by those skilled in the art without departing from the scope and spirit of the invention. For example, the recycling of liquid from separator 50 is entirely optional and can be eliminated if desired. If the liquid from separator 50 is not recycled, then all of the liquid required for injection into the system via conduits 24 and 62 can be fresh liquid from supply 70 as described above.

The invention claimed is:

1. The method of operating a gas pumping system including a first stage rotary lobe pump which pumps gas to a second stage liquid ring, said rotary lobe pump having a gas inlet and a gas outlet, said outlet containing a compression zone in which gas is compressed by said rotary lobe pump prior to passage to said liquid ring pump, said method comprising the step of:

injecting a cooling liquid into said compression zone via a cooling liquid injection port disposed in said outlet, said injection port directing said cooling liquid to flow countercurrent to the flow of the gas being compressed in said compression zone so that the liquid mixes intimately with the gas being compressed in that zone and reduces the temperature rise of the gas in that zone in order to reduce heat transfer from that gas to the lobes of the rotary lobe pump and to thereby cool all parts of the rotary pump.

2. The method defined in claim 1 wherein the injecting step comprises the step of:

causing at least some of the liquid to traverse at least a portion of the compression zone and impinge on the lobes of the rotary lobe pump adjacent to the compression zone to help ensure thorough mixing of the liquid with the gas in the compression zone.

3. The method defined in claim 1 wherein the liquid ring pump discharges excess pumping liquid, and wherein the method further comprises the step of:

recirculating at least some of the excess pumping liquid for use as at least part of the cooling liquid in the injecting step.

4. The method defined in claim 3 wherein the recirculating step comprises the step of:

cooling at least some of the excess pumping liquid to be used in the injecting step.

5. The method defined in claim 1 wherein the liquid is water.

6. The method defined in claim 5 wherein the liquid ring pump uses water as the pumping liquid.

7. The method defined in claim 1 wherein the system is designed to produce a subatmospheric gas pressure at the rotary lobe pump inlet, and wherein the subatmospheric gas pressure is approximately at or below the vapor pressure of the cooling liquid.

8. In a gas pumping system including a first stage rotary lobe pump having a gas inlet and a gas outlet for pumping gas to a second stage liquid ring pump, said rotary lobe pump having a compression zone in said outlet in which gas is compressed by said rotary lobe pump prior to passage to said liquid ring pump, the improvement comprising:

means disposed in said outlet for injecting a cooling liquid into said compression zone, said means for injecting directing said cooling liquid to flow countercurrent to the flow of the gas being compressed in said compression zone so that the liquid mixes intimately with the gas being compressed in that zone and reduces the temperature rise of the gas in that zone in order to reduce heat transfer from that gas to the lobes of the rotary lobe pump and to thereby cool all parts of the rotary lobe pump.

9. The apparatus defined in claim 8 wherein the means for injecting causes at least some of the liquid to traverse at least a portion of the compression zone and impinge on the lobes of the rotary lobe pump adjacent to the compression zone to help ensure thorough mixing of the liquid with the gas in the compression zone.

10. The apparatus defined in claim 8 wherein the liquid ring pump discharges excess pumping liquid, and wherein the apparatus further comprises:

means for recirculating at least some of the excess pumping liquid to the means for injecting for use as at least part of the cooling liquid.

11. The apparatus defined in claim 10 wherein the means for recirculating comprises:

means for cooling at least some of the excess pumping liquid recirculated to the means for injecting.

12. The apparatus defined in claim 8 wherein the liquid is water.

13. The apparatus defined in claim 12 wherein the liquid ring pump uses water as the pumping liquid.

14. The apparatus defined in claim 8 wherein the system is designed to produce a subatmospheric gas pressure at the rotary lobe pump inlet, and wherein the subatmospheric gas pressure is approximately at or below the vapor pressure of the cooling liquid.

15. A system for pumping a gas from a system gas inlet to a system gas outlet and thereby raising the pressure of said gas from a relatively low system inlet pressure to a relatively high system outlet pressure comprising:

a rotary lobe pump having a rotary lobe pump gas inlet and a rotary lobe pump gas outlet containing a compression zone in which gas is compressed by said rotary lobe pump, said rotary lobe pump gas inlet being connected to said system gas inlet for pumping said gas from said system gas inlet to said rotary lobe pump gas outlet and thereby raising the pressure of said gas from said system inlet pressure to an interstage pressure in said compression zone and said rotary pump gas outlet, said interstage pressure being intermediate said system inlet pressure and said system outlet pressure;

means disposed in said rotary pump gas outlet for injecting a cooling liquid into said compression zone, said means for injecting directing said cooling liquid to flow countercurrent to the flow of the gas being compressed in said compression zone so that said liquid mixes intimately with said gas being compressed in that zone and reduces the temperature rise of said gas in that zone in order to reduce heat transfer from said gas to the lobes of said rotary lobe pump and to thereby cool all parts of the rotary lobe pump; and a liquid ring pump having a liquid ring pump gas inlet and a liquid ring pump gas outlet, said liquid ring pump gas inlet being connected to said rotary lobe pump gas outlet and said liquid ring pump gas outlet being connected to said system gas outlet for pumping said gas from said rotary lobe pump gas outlet to said system gas outlet and thereby raising the pressure of said gas from said interstage pressure to said system outlet pressure.

16. The system defined in claim 15 wherein said cooling liquid is compatible with the liquid used in said liquid ring pump for pumping said gas, and wherein said cooling liquid, after mixing with said gas in said compression zone, is conveyed with said gas into said liquid ring pump where said cooling liquid joins and becomes part of said liquid used for pumping said gas.

17. The system defined in claim 16 wherein at least some of said cooling liquid remains in liquid form at all times during mixing with said gas in said compression zone and conveyance with said gas into said liquid ring pump wherein said cooling liquid joins and becomes part of said liquid used for pumping said gas.

18. The system defined in claim 17 wherein said cooling liquid is the same as said liquid used in said liquid ring pump for pumping said gas.

19. The system defined in claim 18 wherein said cooling liquid is water.

20. The system defined in claim 17 wherein said system inlet pressure is approximately at or below the vapor pressure of said cooling liquid.

21. The system defined in claim 20 wherein said interstage pressure is above the vapor pressure of said cooling liquid.

22. The system defined in claim 17 wherein said liquid ring pump discharges a portion of said liquid used for pumping said gas to said liquid ring pump gas outlet, and wherein said system further comprises:

means connected between said liquid ring pump gas outlet and said system gas outlet for separating said gas from said portion of said liquid and for conveying said gas to said system gas outlet and for conveying said portion of said liquid to a liquid conduit.

23. The system defined in claim 22 further comprising:

means for connecting said liquid conduit to said means for injecting so that at least some of the liquid in said liquid conduit is used as at least some of said cooling liquid.

24. The system defined in claim 23 further comprising:

means for cooling said at least some of said liquid in said liquid conduit prior to using said at least some of said liquid as said at least some of said cooling liquid.

* * * * *